United States Patent [19]

Krueger

[11] Patent Number: 5,025,579

[45] Date of Patent: Jun. 25, 1991

[54] PICTURE FRAME

[76] Inventor: Barry D. Krueger, 240 E. Johnson St., Fond du Laca, Wis. 54935

[21] Appl. No.: 520,045

[22] Filed: May 7, 1990

[51] Int. Cl.[5] ..... A47G 01/06

[52] U.S. Cl. ..... 40/452; 40/154

[58] Field of Search ..... 40/158.1, 154, 152

[56] References Cited

U.S. PATENT DOCUMENTS

| | | | |
|---|---|---|---|
| 154,581 | 9/1874 | Bushnell | 40/158.1 |
| 156,788 | 11/1874 | Hale | 40/158.1 |
| 457,478 | 8/1891 | Koskul | 40/154 |
| 723,696 | 3/1903 | Maine | 40/154 |
| 1,358,916 | 11/1920 | Anderson | 40/158.1 |
| 1,940,328 | 12/1933 | Schrotenboer | 40/152 |
| 2,458,349 | 1/1949 | Cross | 40/154 |
| 4,110,923 | 9/1978 | Shore | 40/152 |
| 4,231,833 | 11/1980 | Lieberman | 40/158.1 |
| 4,777,746 | 10/1988 | Brooks | 40/158.1 |

*Primary Examiner*—Kenneth J. Dorner
*Assistant Examiner*—Cassondra Hope
*Attorney, Agent, or Firm*—Andrus, Sceales, Starke & Sawall

[57] ABSTRACT

A picture frame includes a base with a plurality of mat layers permanently mounted thereon to provide a multi-layered matted frame for displaying framed objects such as photographs and the like.

6 Claims, 2 Drawing Sheets

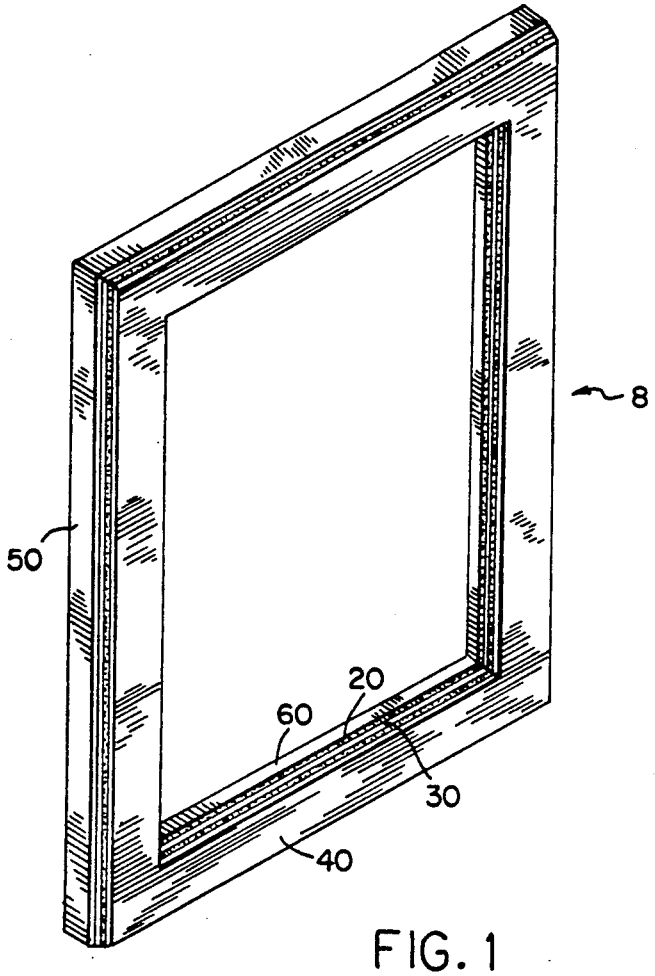
FIG. 1
FIG. 4
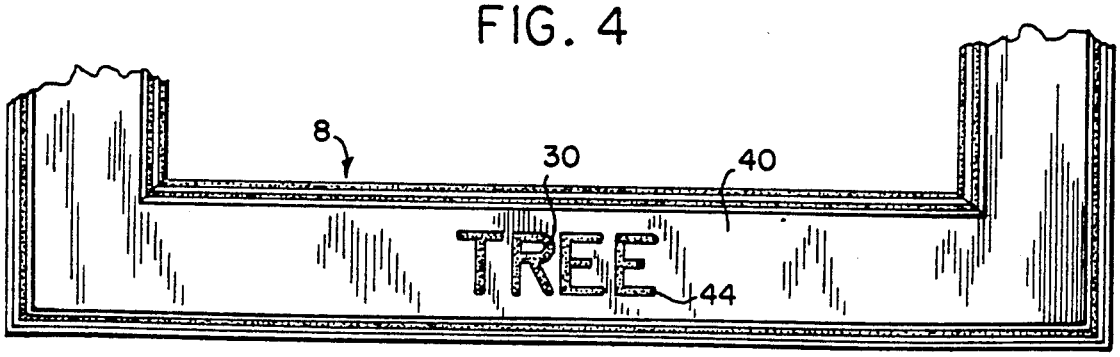

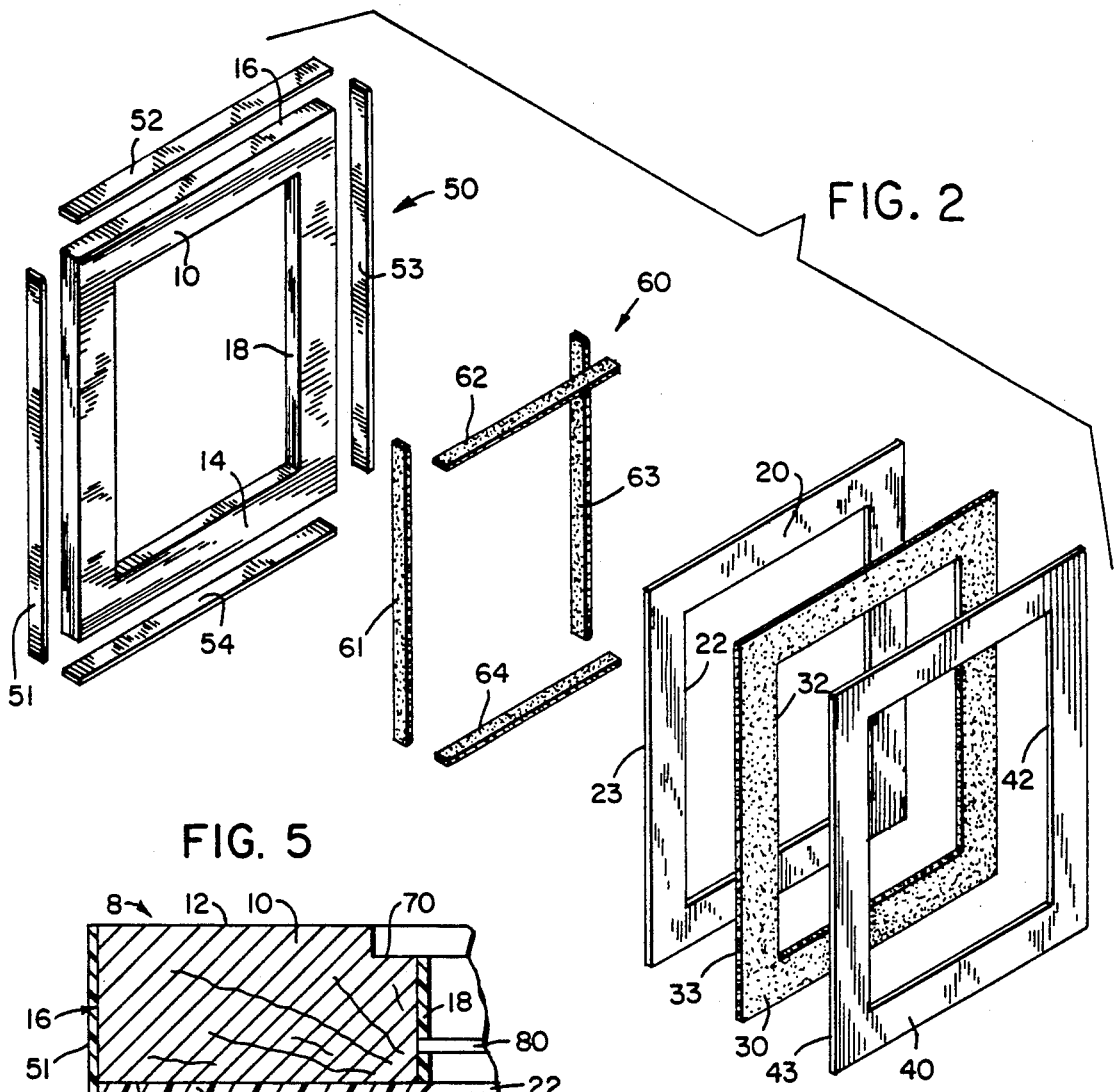
FIG. 2
FIG. 5
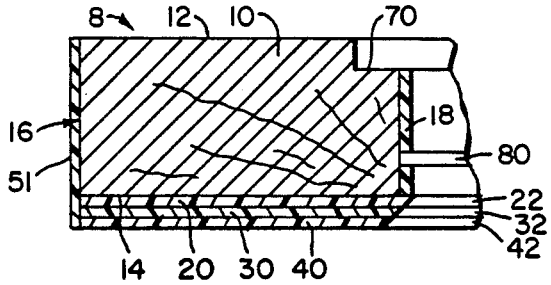
FIG. 3
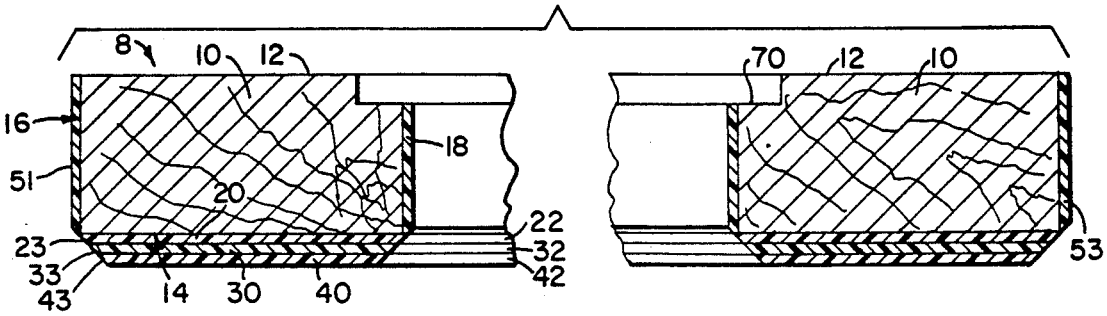

PICTURE FRAME

BACKGROUND

The invention is directed to matted picture frames, and in particular, matted picture frames where the frame and matting are of a unitary construction.

Matted pictures are-well known. However, in most cases the matting is not part of the frame but is a separate material secured to the frame in much the same manner as the object to be framed. Multi-layered mattings are also known and are often used to provide a multi-colored appearance. These are also mounted in the frame in the same manner as the object to be framed.

The present invention provides a multi-layered, matted picture frame which is unique in both appearance and construction. The matting is an integral part of the frame and provides a unique, contemporary means for displaying photographs for other objects which are enhanced by matted framing.

SUMMARY OF THE INVENTION

The present invention comprises a picture frame made of a base having a plurality of layered mat members secured thereto, each with offset edges to expose the preceding layer and provide a multi-layered matting effect. The frame borders may be constructed of the same material as the mat layers, if desired. The finished frame provides a unique, contemporary means for displaying framed objects.

The material of choice for the mat layers is solid core, plastic laminate. However, other materials with the same features may be used with equally desirable results.

DESCRIPTION OF THE DRAWINGS

FIG. 1 is a perspective view of a picture frame according to the present invention.

FIG. 2 is an exploded view of the picture frame of FIG. 1 illustrating all of the components prior to assembly.

FIG. 3 is a fragmented cross-section of the picture frame of FIG. 1.

FIG. 4 is an alternative embodiment of the picture frame, showing a cut design in the outer mat layer.

FIG. 5 is an alternative design of the picture frame showing a squared outer edge and a mitered inner edge.

DETAILED DESCRIPTION

As illustrated in FIG. 2, picture frame 8 comprises a base 10 made of a solid material such as particle board or the like. The base may be of unitary construction, as shown, or may be assembled from a number of pieces suitably secured together. Unitary construction is preferred since this makes the ultimate assembly more rigid. The base defines the basic shape of the frame and includes a back surface 12, a front surface 14, an outer perimeter 16 and an inner wall 18. As shown, the base is rectangular. However, it will be understood that the shape of the base is a matter of choice and the inner wall, in particular, may be of any configuration to provide the desired effect for the object to be framed. In the preferred embodiment, the back surface of the base is finished whereas the remaining surfaces are unfinished.

The remaining components of the basic frame are shown in FIGS. 1, 2 and 3 and, in the preferred embodiment, comprise a solid core plastic laminate such as, by way of example, solid core Formica brand laminate. The advantage of a solid core material is that the color of the material is consistent throughout its thickness, providing a solid color finished look to the edges of each component.

A first solid core mat number 20 is mounted directly on the front surface of the base by a suitable adhesive such as Formica brand laminate adhesive or the like. Succeeding mat members 30 and 40 are likewise secured in layered fashion to the preceding mat member. Each mat member conforms substantially to the shape of the base, but the inner wall adjacent edges 22, 32 and 42 are offset to expose the preceding mat layers.

The offset edges may be mitered at an acute angle, as shown in FIG. 3 to give a smooth continuous appearance to the inner edge. The mat members may be of different colors to provide contrasting color strips on the inner border, as best seen in FIG. 4. The outer mat layer may include a design or message 44 cut in and through the layer to expose the preceding mat layer 30.

As shown in FIG. 3, the outer perimeter adjacent edges 23, 33 and 43, respectively, of each mat layer may be offset to provide a mitered appearance similar to the inner edge, as shown in FIGS. 3 and 4. As shown in FIG. 5, the edges may also be square cut so that only the outer layer is exposed.

The outer border 50 comprises sections 51, 52, 53 and 54 secured to the outer perimeter of the base. The outer border may be cut to expose any, all or none of the outer edges of the mat layers, see FIG. 3 and 5.

The inner border 60 comprises sections 61, 62, 63 and 64 mounted on the inner wall 18 of the base and conforming substantially thereto so that the inner edges of the mat members are exposed. A groove or recess 70 may be provided in the base so that the picture to be framed will be flush with the back surface of the base when mounted in the frame. A second groove or recess 80 may be provided in the inner border to mount a dust cover or the like (not shown) in spaced relationship with the picture.

While the frame is described for mounting a picture or photograph, it will be understood that the frame is suitable for mounting mirrors and a variety of other objects. Further while specific embodiments are shown and described, it will be understood that the invention includes all modifications and variations within the scope and spirit of the following claims.

What is claimed is:

1. A picture frame comprising:

a. a base having a back surface, a front surface, an outer perimeter and an inner wall, the inner wall defining the boundary of the picture to be framed;

b. a first mat component of solid core plastic laminate material substantially conforming to the shape of the front surface of the base and mounted thereon;

c. at least one additional mat component of solid core plastic laminate material substantially conforming to the shape of the first mat member and mounted thereon; d. an outer border component of solid core plastic laminate material, substantially conforming to the outer perimeter of the base and mounted thereon; and e. an inner border component of solid core plastic laminate material, substantially conforming to the inner wall of the base and mounted thereon wherein all exposed edges of each of the various components are of the same material and color as the surface of the respective component.

2. A picture frame according to claim 1, wherein the first and additional mat members are of different colored solid core plastic laminate materials.

3. A picture frame according to claim 1, including a design cut in and through the additional mat member to expose the surface of the first mat member when mounted thereon.

4. A picture frame according to claim 1, wherein the inner wall adjacent edge of each succeeding mat member is offset from the inner wall adjacent edge of the preceding mat member.

5. A picture frame according to claim 4, wherein each inner wall adjacent edge is cut at an acute angle relative to the surface of the base to provide a mitered edge about the inner wall.

6. A picture frame according to claim 1, wherein the base includes means for mounting the picture to be framed adjacent to the back surface of the base.

* * * * *